United States Patent [19]

Kodama et al.

[11] 4,390,330

[45] Jun. 28, 1983

[54] LUBRICATING OIL SUPPLY MEANS FOR ROTARY PISTON ENGINES

[75] Inventors: Hiroshi Kodama; Tadayuki Seto, both of Hiroshima, Japan

[73] Assignee: Toyo Kogyo Co. Ltd., Hiroshima, Japan

[21] Appl. No.: 181,614

[22] Filed: Aug. 26, 1980

[30] Foreign Application Priority Data

Aug. 27, 1979 [JP] Japan ..... 54-109273

[51] Int. Cl.[3] ..... F01C 1/22; F01C 21/04; F01M 1/04

[52] U.S. Cl. ..... 418/97; 184/6.26

[58] Field of Search ..... 418/88, 97–99; 184/6.26

[56] References Cited

U.S. PATENT DOCUMENTS

| | | | |
|---|---|---|---|
| 3,245,386 | 4/1966 | Bentele | 418/99 |
| 3,280,812 | 10/1966 | Peras | 418/97 |
| 3,420,214 | 1/1969 | Bensinger et al. | 418/97 |
| 3,809,021 | 5/1974 | Lamm | 418/97 |
| 3,904,329 | 9/1975 | Steinwart | 418/99 |
| 3,994,642 | 11/1976 | Johannes | 418/99 |

FOREIGN PATENT DOCUMENTS

| | | | |
|---|---|---|---|
| 698758 | 11/1940 | Fed. Rep. of Germany | 418/98 |
| 4314043 | 6/1965 | Japan . | |

*Primary Examiner*—John J. Vrablik

*Attorney, Agent, or Firm*—Fleit, Jacobson & Cohn

[57] ABSTRACT

Lubricating oil supply device for a rotary piston engine including an oil port opened to a working chamber at the trochoidal inner wall of the rotor housing, a bore formed radially in the rotor housing to communicate with the oil port, a plug fitted to the bore close to an end adjacent to the oil port and having a nozzle opening opposed to the wall of the bore, an oil supply conduit extending axially in the bore and opening to the bore in the vicinity of the plug, and an air passage opening the bore to the atmosphere.

13 Claims, 4 Drawing Figures

LUBRICATING OIL SUPPLY MEANS FOR ROTARY PISTON ENGINES

The present invention relates to rotary piston engines and more particularly to lubricating oil supply means for rotary piston engines.

Conventional rotary piston engines comprise a casing which includes a rotor housing having an inner wall of trochoidal configuration and a pair of side housings attached to the opposite sides of the rotor housing to define therein a rotor cavity of trochoidal configuration. A rotor of substantially polygonal configuration is disposed in the rotor cavity for rotation with apex portions in sliding contact with the inner wall of the rotor housing. Thus, in the casing, there is defined, by the inner wall of the rotor housing and flanks of the rotor, working chambers of which volumes cyclically change in response to a rotation of the rotor to carry out intake, compression, combustion or expansion and exhaust strokes. The casing is further provided with an intake passage for providing a supply of intake mixture to the working chamber which is in the intake stroke. The rotor is provided at the apex portions with apex seals and at the opposite side surfaces with side seals which are slidably engaged with the inner wall of the rotor housing and the inner surface of the side housings for providing a gas-tight seal for the working chambers.

For the purpose of supplying the inner surfaces of the casing and the seals on the rotor with lubricant oil, conventional rotary piston engines have been provided with a lubricant oil supplying device which is adapted to supply a metered amount of lubricant oil to the intake passage so that the oil is carried by the intake mixture flow into the intake working chamber. However, in this type of system, substantial amount of the lubricant oil is atomized in the intake passage and consumed by being burned together with the fuel component in the mixture. Thus, it is only a portion of the supplied lubricant oil that is effectively used for forming films on the inner surfaces of the casing and on the sealing members. It will therefore be understood that, although the supplied oil is metered in accordance with the rotary speed of and the load on the engine, an increased amount of oil has to be supplied in order to compensate for the amount which will be consumed by being burned in the working chamber.

In order to eliminate the above problem, proposals have been made to supply lubricant oil directly to the working chamber. For example, in the U.S. Pat. No. 3,245,386, there is disclosed a rotary piston engine having an apex seal lubricating means mounted in a radial bore formed in the rotor housing. The lubricating means includes a valve mechanism which is adapted to be opened by the apex seal when the apex seal is passed over the valve mechanism so that lubricating oil is directly supplied to the intake working chamber. In Japanese patent publication Sho No. 43-14043, there is disclosed a rotary piston engine in which an intake port is defined in the rotor housing by a bush embedded therein and a lubricating oil supply passage is formed along the outer surface of the bush.

In the arrangement as proposed by the aforementioned U.S. patent, however, it is hardly possible to ensure a sufficient supply of lubricant oil since the valve mechanism in the lubricating means is opened only when the apex seal is passed thereover. Further, in the arrangement as shown in the Japanese patent publication, since the lubricating oil supply port is located very close to the intake port, there is a strong possibility that the lubricating oil is carried by the intake mixture flow which has just been introduced into the working chamber so that a noticeable amount of oil may be consumed in the intake mixture. Further, since the lubricating oil supply port is exposed to the intake working chamber, the intake suction pressure is applied thereto particularly in an operating condition wherein the engine throttle valve is in the minimum opening position. Therefore, the result is such that an excessive amount of oil is drawn under such intake pressure into the intake working chamber and oil consumption is therefore increased.

It is therefore an object of the present invention to provide a rotary piston engine with lubricating oil supply means which can supply an adequate amount of lubricating oil to the inner wall surface of the rotor housing.

Another object of the present invention is to provide lubricating oil supply means for a rotary piston engine, in which oil is not discharged into the working chamber but welled-up in oil supply port means formed in the inner wall of the rotor housing.

A further object of the present invention is to provide lubricating oil supply means for a rotary piston engine, in which means is provided for preventing oil from being drawn under an intake suction pressure in the working chamber.

According to the present invention, the above and other objects can be accomplished by a rotary piston engine including a casing which comprises a rotor housing having a trochoidal inner wall and a pair of side housings secured to the opposite sides of the rotor housing, a substantially polygonal rotor disposed in said casing for rotation with apex portions in sliding contact with the inner wall of the rotor housing to thereby define working chambers by flanks of said rotor and said inner wall of the rotor housing, lubricating oil supply means including oil supply port means opening at the inner wall of the rotor housing, bore means having an inner wall and formed in said rotor housing so as to lead to said oil, supply port means, lubricating oil supply conduit means provided in said bore means, opening means provided in said bore means and opposed to said inner wall of the bore means for directing lubricant oil supplied through the conduit means against said inner wall of the bore means, air passage means formed in said rotor housing and communicated with said bore means. The lubricating oil supply conduit means may be connected with a metering oil pump which provides a supply of lubricant oil in accordance with engine operating conditions. The lubricant oil supplied through the conduit means is discharged through the opening against the inner wall of the bore means preferably in the vicinity of the port means so as to be stagnated in the area around the oil supply port means. Then, the oil is welled-up from the port means to lubricate the surface of the inner wall of the rotor housing.

The air passage means may be opened to the atmosphere so that air is introduced into the bore when an intake suction pressure is applied to the oil supply port means. This arrangement is advantageous because it is possible to prevent an excessive amount of oil from being drawn into the working chamber under the intake suction pressure. Preferably, the opening means is of an effective cross-sectional area which is smaller than that of the port means. The opening means may be formed at an end portion of the conduit means, however, in a preferable aspect of the present invention, it is provided in plug means fitted to the bore means in the vicinity of the port means so as to provide an oil stagnating or accummulating space in the bore means between the plug means and the port means. The inner wall of the bore means to which said opening means is opposed may be the circumferential wall, or alternatively, may be an annular wall defined by a shoulder formed between the bore means and the port means.

The above and other objects and features of the present invention will become apparent from the following descriptions of preferred embodiments taking reference to the accompanying drawings, in which.

Figure 1:
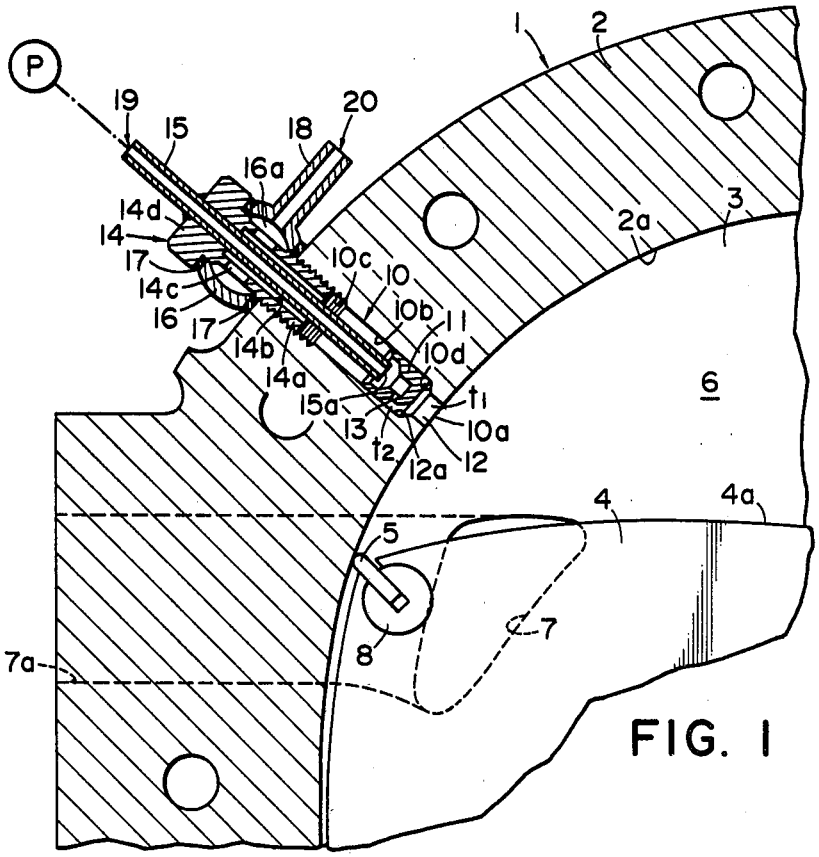
FIG. 1 is a fragmentary sectional view of a rotary piston engine having a lubricating oil supply device in accordance with one embodiment of the present invention.

Referring now to the drawings, particularly to FIG. 1, there is shown a rotary piston engine including a casing 1 comprised of a rotor housing 2 having a trochoidal inner wall 2*a* and a pair of side housings 3 attached to the opposite sides of the rotor housing 2 to define a rotor cavity therein. A rotor 4 of triangular configuration is disposed in the casing 1 and provided at each apex portion with an apex seal 5 and a corner seal 8. As well known in the art, the rotor 4 is mounted for rotation with the apex seals 5 in sliding contact with the inner wall 2*a* of the rotor housing 2. Thus, in the casing 1, there is defined a working chamber 6 of variable volume by the inner wall 2*a* of the rotor housing 2 and each flank 4*a* of the rotor 4. The volume of the working chamber 6 changes cyclically in response to a rotation of the rotor 4 to conduct repeated cycles of intake, compression, combustion, expansion and exhaust strokes. One of the side housings 3 is formed with an intake port 7 which is communicated with an intake passage 7*a*.

The rotor housing 2 is provided with a lubricating oil supply device 10 which includes a lubricating oil supply port 10*a* and a bore 10*b* which is radially extending in the rotor housing 2. At the radially outer end, the bore 10*b* is provided with a threaded portion 10*c*. The port 10*a* has an axial length $t_1$ and is opened at the inner wall of the rotor housing 2 at the working chamber 6 which is in the intake stroke. The bore 10*b* is communicated at the radially inner end with the port 10*a* and an annular shoulder portion 10*d* is formed between the port 10*a* and the bore 10*b*.

The bore 10*b* is fitted with a plug 11 in the vicinity of the port 10*a* to provide an oil stagnating space 12 by the radially inner end portion of the bore 10*b* and the port 10*a*. As shown in FIG. 1, the plug 11 is cut-off at a circumferential portion to provide an axial space $t_2$ leading to the space 12. The plug 11 is formed with a radial nozzle 13 which is opposed to the inner wall surface 12*a* of the space 12.

A threaded member 14 having an externally threaded portion 14*a* is engaged with the threaded portion 10*c* of the bore 10. The threaded member 14 is formed with an axial bore 14*b* opening at the axially inner end of the member 14 and radial holes 14*c* connected with the axially outer end of the bore 14*b*. An oil supply tube 15 leading from an oil pump P extends axially through the bore 14*b* with an annular space between the tube 15 and the wall surface of the bore 14*b*. The tube 15 is secured to the threaded member 14 by suitable means such as welding and forms an oil supply passage 19 which opens to the bore 10*b* in the vicinity of the plug 11 through the inner end 15*a* of the tube 15.

The threaded member 14 has a head 14*d* and a ring member 16 is fitted between the head 14*d* and the rotor housing 2 with interventions of seals 17. The ring member 16 encircles the radial holes 14*c* in the threaded member 14 and provides a space 16*a* leading through the holes 14*c* to the space between the tube 15 and the inner wall of the bore 14*b*. The ring member 16 is provided with an air supply tube 18 which opens to atmosphere to form an air passage 20 communicating with the oil supply passage 19 at the bore 10*b* in the vicinity of the plug 11.

In operation, the oil pump P provides a supply of a metered amount of oil in accordance with the speed and load of the engine. The oil is fed through the passage 19 formed by the tube 15 and discharged to the bore 10*b* behind the plug 11. The oil is mixed with the air introduced through the passage 20 and then discharged through the nozzle 13 against the wall 12*a* of the stagnating space 12. Since the oil through the nozzle 13 impinges upon the inner wall 12*a* of the space 12, its kinetic energy is substantially decreased and the oil is stagnated in the space 12. Then, the oil is welled-up through the port 12 to lubricate the inner wall 2*a* of the rotor housing 2. The oil on the inner wall 2*a* is spread uniformly by the apex seal 5 so that a film of lubricating oil is uniformly formed throughout the inner wall 2*a* of the rotor housing 2. Preferably, the nozzle 13 has a cross-sectional area which is smaller than that of the port 10*a* so that the oil through the nozzle 13 is expanded in the space 12 and goes out of the space 12 through the port 10*a* at a substantially decreased speed. Thus, it is possible to prevent the oil from being injected through the port 10*a* into the working chamber 6.

In an idling or decelerating operation of the engine or when the engine is coasting, a strong suction pressure is produced in the working chamber 6. The suction pressure is then applied through the port 10*a* and the space 12 to the nozzle 13 and then to the end 15*a* of the tube 15 which is the outlet end of the oil supplying passage 19. However, since the air is drawn under the suction pressure into the area around the end 15*a* of the tube 15 through the air passage 20, it is possible to prevent an excessive amount of oil from being drawn through the tube 15 under the suction pressure. It will therefore be understood that the amount of supply of oil can be appropriately maintained even when a strong suction pressure is produced in the working chamber 6. In the illustrated arrangement, the air passage 20 leads to the space around the outlet end 15*a* of the tube 15 so that it is possible to draw the air without any delay whenever a suction pressure is transmitted to the space to thereby prevent an adverse increase of the lubricating oil supply. The illustrated arrangement is further advantageous in that the substantial portion of the air passage 20 is formed around the tube 15 whereby it is unnecessary to drill a hole in the rotor housing separately only for the purpose of providing the air passage. It should of course be noted that the air supply tube 18 may be extended to the air cleaner for the engine intake system so that a clean air is drawn to the tube 18.

Figure 2:
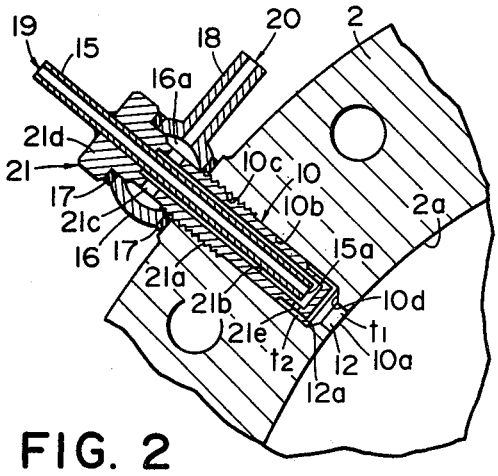
FIG. 2 is a fragmentary sectional view of a lubricating oil supply device in accordance with another embodiment of the present invention.

Referring to FIG. 2, there is shown another embodiment of the present invention. In the drawing, corresponding parts are shown by the same reference numerals as in FIG. 1. In this embodiment, the plug 11 and the threaded member 14 in the previous embodiment are substituted by a threaded hollow member 21 which has an externally threaded portion 21*a* for engagement with the threaded portion 10*c* in the bore 10*b*. The threaded member 21 has a head 21*d* at one end for engagement with the ring member 16 through a seal 17. The member 21 is further formed with an axial bore 21*b* which is closed at an end opposite to the head 21*d*. The closed end of the member 21 has a decreased outer diameter to provide an annular space $t_2$ between the member 21 and the bore 10*b* and a radially directed nozzle 21*e* is formed in the member 21 so as to be opened to the space $t_2$ and opposed to the inner wall 12*a*. The member 21 is further formed with radial holes 21*c* which connect the space 16*a* in the ring member 16 with the bore 21*b*. In the member 21, there extends an oil supply tube 15 which terminates at an end 15*a* in the vicinity of the closed end of the member 21. It will therefore be understood that the operation of this embodiment is similar to that in the embodiment shown in FIG. 1.

Figure 3:
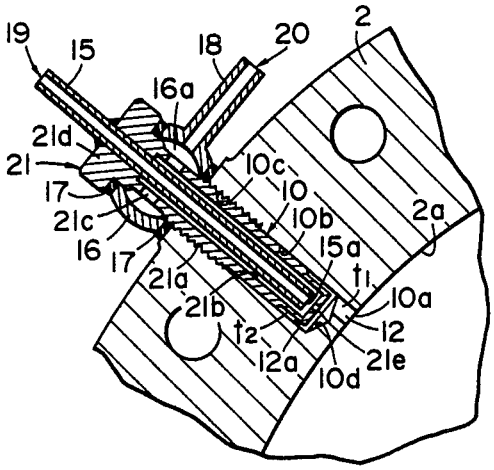
FIG. 3 is a sectional view similar to FIG. 2 but showing a further embodiment of the present invention; and, FIG. 4 is a sectional view similar to FIG. 1 but showing a further embodiment of the present invention.

FIG. 3 shows a modification of the arrangement shown in FIG. 2 so that corresponding parts are shown by the same reference numerals as in FIG. 2. In the embodiment shown in FIG. 3, the oil supply port 10*a* is offset from the axis of the bore 10*b* and the nozzle 21*e* in the threaded member 21 is formed at the end wall thereof. Thus, the nozzle 21*e* is opposed to the shoulder 10*d* formed between the port 10*a* and the bore 10*b* so that the oil through the nozzle 21*e* impinges upon the shoulder 10*d*. The arrangement is advantageous in that the nozzle 21*e* can readily be cleaned when it is clogged by dirty materials.

Figure 4:
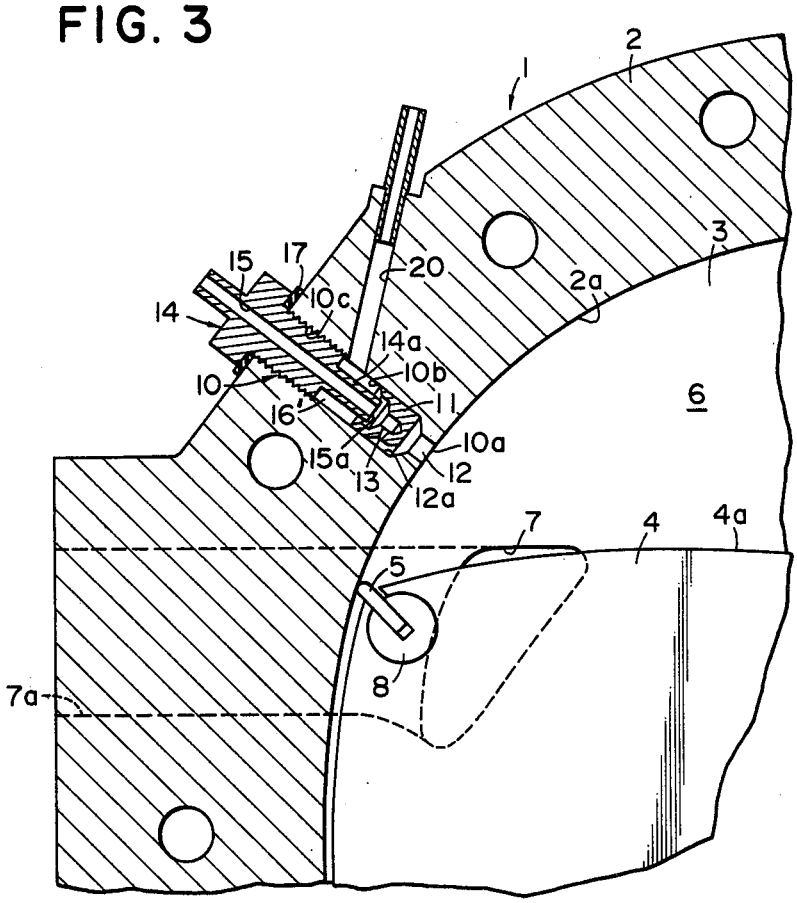

Referring to FIG. 4, there is shown a further embodiment of the present invention in which the oil supply port 10*a* and the bore 10*b* are similar in configuration with those in the embodiment shown in FIG. 1. In the bore 10*b*, there is fitted a plug 11 which is also of a configuration similar to that of the plug 11 shown in FIG. 1. The bore 10*b* is formed with an internally threaded portion 10*c* and an externally threaded member 14 is engaged with the threaded portion 10*c*. The threaded member 14 is formed with an axial extension 14*a* of a reduced diameter terminating in the bore 10*b* in the vicinity of the plug 11. The threaded member 14 has an axial hole 15 which extends throughout the length of the member 14 and has an outlet 15*a* located close to the plug 11. The hole 15 provides an oil supply passage leading from the oil pump. Between the wall of the bore 10*b* and the extension 14*a*, there is formed an annular space 16' and the rotor housing 2 is formed with an air passage 20 opened to the atmosphere. It will be understood that the operation of this embodiment is similar to those in the previous embodiments. The embodiment is considered as advantageous in that the externally threaded member is of a simple construction.

The invention has thus been shown and described with reference to specific embodiments, however, it should be noted that the invention is in no way limited to the details of the illustrated structures but changes and modifications may be made without departing from the scope of the appended claims.

We claim:

1. A rotary piston engine including a casing which comprises a rotor housing having a trochoidal inner wall and a pair of side housings secured to the opposite sides of the rotor housing, a substantially polygonal rotor disposed in said casing for rotation with apex portions in sliding contact with the inner wall of the rotor housing to thereby define working chambers by flanks of said rotor and said inner wall of the rotor housing, lubricating oil supply means including oil supply port means opening at the inner wall of the rotor housing, bore means having an inner wall and formed in said rotor housing so as to lead to said oil supply port means, lubricating oil supply conduit means provided in said bore means, opening means provided in said bore means and having a cross-sectional area smaller than that of the oil supply port means, said opening means being opposed to said inner wall of the bore means for directing lubricating oil supplied through the conduit means against said inner wall of the bore means, and air passage means formed in said rotor housing and communicated with said bore means so as to provide air to a region of said bore means between said lubricating oil supply conduit means and said opening means.

2. A rotary piston engine in accordance with claim 1 in which said opening means is provided in plug means fitted in said bore means close to an end adjacent to said oil supply port means, said lubricating oil supply conduit means having an open outlet end in the vicinity of said plug means.

3. A rotary piston engine in accordance with claim 1 in which said opening means is formed in plug means fitted to said bore means close to an end adjacent to said oil supply port means and said air passage means is formed as an axial through-hole in a member fitted to said bore means at the other end, said air passage means being formed to lead to said bore means between said plug means and said member.

4. A rotary piston engine in accordance with claim 1 in which said oil supply port means is aligned with said bore means.

5. A rotary piston engine in accordance with claim 1 in which said lubricating oil supply conduit means includes a tube extending through the bore means with a clearance therebetween.

6. A rotary piston engine in accordance with claim 5 in which said tube has an end in said bore means and said opening means is formed in plug means fitted to said bore means close to said end of the tube.

7. A rotary piston engine in accordance with claim 5 in which said tube is fitted in a hollow member in which is in turn fitted to said bore means, an annular space being provided between said hollow member and said tube for providing said air passage means.

8. A rotary piston engine in accordance with claim 7 in which said hollow member has a closed end where said opening means is formed, said tube terminating in said hollow member in the vicinity of said closed end.

9. A rotary piston engine in accordance with claim 1 in which said oil supply port means extends through the inner wall of the rotor housing.

10. A rotary piston engine in accordance with claim 9 in which said oil supply port means is aligned with said bore means.

11. A rotary piston engine including a casing which comprises a rotor housing having a trochoidal inner wall and a pair of side housings secured to the opposite sides of the rotor housing, a substantially polygonal rotor disposed in said casing for rotation with apex portins in sliding contact with the inner wall of the rotor housing to thereby define working chambers by flanks of said rotor and said inner wall of the rotor housing, lubricating oil supply means including oil supply port means opening at the inner wall of the rotor housing, bore means having an inner wall and formed in said rotor housing so as to lead to said oil supply port means, lubricating oil supply conduit means provided in said bore means, plug means positioned in said bore means between said lubricating oil supply conduit means and said oil supply port means and spaced from an outlet end of said lubricating oil supply conduit means, said plug means having opening means provided therein opposed to said inner wall of the bore means for directing lubricating oil supplied through the conduit means against said inner wall of the bore means, and air passage means formed in said rotor housing and communicated with said bore means for supplying air to the space between said plug means and the outlet end of said lubricating oil supply conduit means so that air is drawn into the rotor housing through said air passage means and said oil supply port means when negative pressure is created within said rotor housing adjacent said oil supply port means.

12. A rotary piston engine including a casing which comprises a rotor housing having a trochoidal inner wall and a pair of side housings secured to the opposite sides of the rotor housing, a substantially polygonal rotor disposed in said casing for rotation with apex portions in sliding contact with the inner wall of the rotor housing to thereby define working chambers by flanks of said rotor and said inner wall of the rotor housing, lubricating oil supply means including oil supply port means formed in said rotor housing and opening at the inner wall of the rotor housing, bore means having an inner wall and formed in said rotor housing so as to lead to said oil supply port means, lubricating oil supply conduit means provided in said bore means and having an outlet end, opening means provided in said bore means closely spaced from said oil supply port means and from said outlet end of said lubricating oil supply conduit means, said opening means being opposed to said inner wall of the bore means for directing lubricating oil supplied through the lubricating oil supply conduit means against said inner wall of the bore means, and air passage means formed in said rotor housing and communicated with said bore means so as to provide air to a region of said bore means between said outlet end of said lubricating oil supply conduit means and said opening means.

13. A rotary piston engine in accordance with claim 12 in which said oil supply port means is axially aligned with said bore means.

* * * * *